US008002589B1

(12) United States Patent
Yu et al.

(10) Patent No.: US 8,002,589 B1
(45) Date of Patent: Aug. 23, 2011

(54) ELECTRICAL CONNECTOR WITH STRUCTURES FOR PREVENTING ELECTROSTATIC DISCHARGE

(75) Inventors: Wang-I Yu, Jhonghe (TW); Hung-Chi Tai, Jhonghe (TW); Yong Gang Zhang, Taicang (CN)

(73) Assignee: Alltop Electronics (Suzhou) Co., Ltd, Taicang (CN)

( * ) Notice: Subject to any disclaimer, the term of this patent is extended or adjusted under 35 U.S.C. 154(b) by 0 days.

(21) Appl. No.: 12/916,013

(22) Filed: Oct. 29, 2010

(30) Foreign Application Priority Data

Jun. 4, 2010 (CN) ..... 2010 1 0191213
Jun. 4, 2010 (CN) ..... 2010 1 0191219

(51) Int. Cl.
*H01R 24/00* (2011.01)

(52) U.S. Cl. ..... 439/660; 439/924.1; 439/939

(58) Field of Classification Search ..... 439/660, 439/924.1, 939
See application file for complete search history.

(56) References Cited

U.S. PATENT DOCUMENTS

| | | | | |
|---|---|---|---|---|
| 7,021,971 | B2 * | 4/2006 | Chou et al. | 439/660 |
| 7,128,617 | B2 * | 10/2006 | Wang et al. | 439/660 |
| 7,445,505 | B1 | 11/2008 | Yi | |
| 7,485,008 | B1 * | 2/2009 | Yi et al. | 439/660 |
| 7,837,510 | B1 * | 11/2010 | Hung et al. | 439/660 |
| 2010/0297884 | A1 * | 11/2010 | Hung et al. | 439/626 |

FOREIGN PATENT DOCUMENTS

EP 1703597 A1 9/2006

* cited by examiner

*Primary Examiner* — James Harvey
(74) *Attorney, Agent, or Firm* — Sughrue Mion, PLLC

(57) ABSTRACT

An electrical connector includes an insulative housing including a rear base portion and a front tongue portion extending from the base portion along the mating direction, a number of first conductive contacts held in the insulative housing, a number of second conductive contacts held in the insulative housing, and a retainer assembled to the tongue portion of the insulative housing. Each first conductive contact includes a nonelastic first mating portion exposed beyond the tongue portion. The retainer includes opposite first and second faces and defines a number of receiving slots recessed from at least one of the first and second faces to receive the nonelastic first mating portions of the first conductive contacts.

20 Claims, 10 Drawing Sheets

ELECTRICAL CONNECTOR WITH STRUCTURES FOR PREVENTING ELECTROSTATIC DISCHARGE

BACKGROUND OF THE INVENTION

1. Field of the Invention

The present invention relates to an electrical connector, more particularly to an electrical connector compatible to standard Universal Serial Bus (USB) 2.0 connector.

2. Description of Related Art

Recently, personal computers (PC) are used of a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-Speed devices typically only operate at half of the full theoretical (60 MB/s) data throughput rate. Most Hi-Speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of High-Speed serial bus interfaces.

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals.

The existing USB connectors have a small size but low transmission rate, while other non-USB connectors (PCI Express, SATA, et al) have a high transmission rate but large size. Neither of them is desirable to implement modern high-speed, miniaturized electronic devices and peripherals. To provide a kind of connector with a small size and a high transmission rate for portability and high data transmitting efficiency is much desirable. In 2007, led by Intel, a technology named USB 3.0 is developed by Intel, HP, NEC, NXP semiconductor, and TI etc which realize rapid, instant signal transmission.

USB 3.0 is compatible with USB 2.0 very well and adds another set of contacts for high-speed signal transmission based on USB 2.0. The added set of contacts comprises two pairs of differential contacts and a grounding contact located between the two pairs of differential contacts for suppressing cross-talk when high-speed signal transmission. The problem existed at present is how to assemble two sets of contacts to the same insulative housing or how to manufacture an insulative housing capable of containing two sets of contacts because of compact size of current USB 2.0. Usually, for saving space, many manufacturers utilize insert-molding technology to mold one set of contacts together with an insulative housing, and then assemble the other set of contacts to the insulative housing. However, insert-molding technology is relatively expensive, and with relatively high doorsill, it is not beneficial for manufacturers to decrease prices of the electrical connector and improve competition ability thereof. Further, because electrical connectors are mounted on a printed circuit board which is equipped with a lot of electric components. When a pair of connectors mates with each other, the ESD (electrostatic discharge) phenomenon generates as the pair of connectors carry contrary charges. Actually, when people contact the electrical connectors or the contacts of the connectors, ESD can be generated. When the environmental humidity is below 50%, the instant voltage generated by static charge of people exceeds above 20000 voltages. In general, the current generated by ESD is small, but the voltages generated by ESD is capable of destroying some electric components thoroughly, especially electronic components mounted on the printed circuit board. Hence, when the connectors are mounted on the printed circuit board, they are prone to being destroyed if there is an ESD phenomenon.

Hence, it is desired to design an improved electrical connector to address the problems mentioned above.

BRIEF SUMMARY OF THE INVENTION

Accordingly, an object of the present invention is to provide an electrical connector having improved structures for preventing ESD phenomenon.

In order to achieve the above-mentioned object, an electrical connector in accordance with the present invention comprises an insulative housing comprising a rear base portion and a front tongue portion extending from the base portion along the mating direction, a plurality of first conductive contacts held in the insulative housing, a plurality of second conductive contacts held in the insulative housing, and a retainer assembled to the tongue portion of the insulative housing. The first conductive contacts comprise at least one pair of differential contacts for transmitting high-speed signals. Each first conductive contact comprises a nonelastic first mating portion exposed beyond the tongue portion, a first retention portion received in the base portion and the tongue portion of the insulative housing and located in a surface different from that of the first mating portion, and a first tail portion extending from the first retention portion and extending beyond the base portion. Each second conductive contact comprises an elastic second mating portion received in the tongue portion to be located behind the nonelastic first mating portion along the mating direction, a second retention portion interferentially received in the base portion of the insulative housing, and a second tail portion extending from the second retention portion and beyond the base portion. The retainer comprises opposite first and second faces and defines a plurality of receiving slots recessed from at least one of the first and second faces to receive the nonelastic first mating portions of the first conductive contacts.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
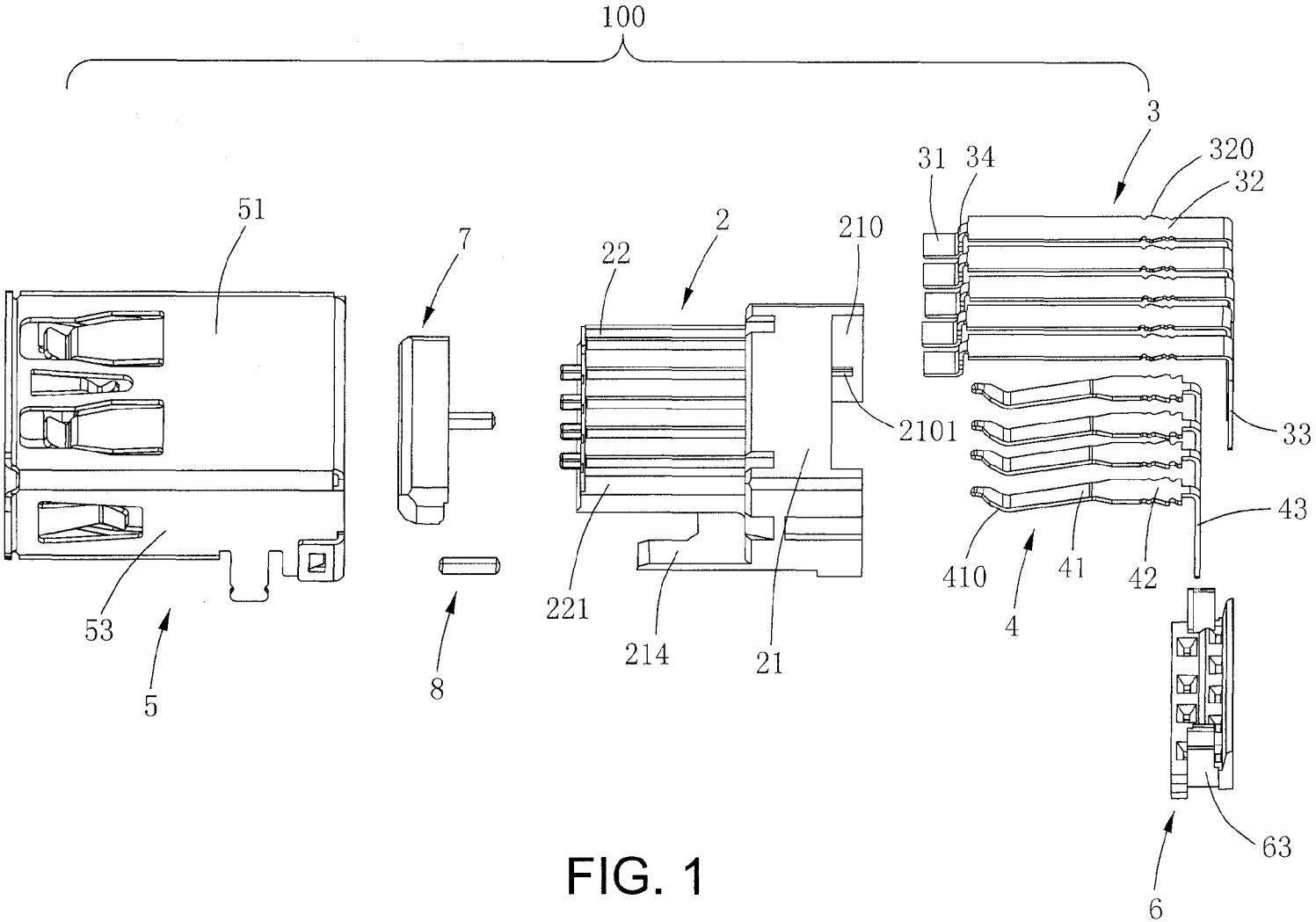
FIG. 1 is an exploded, perspective view of an electrical connector in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Within the following description, a standard USB connector, plug, and signaling all refer to the USB architecture described within the Universal Serial Bus Specification, 2.0 Final Draft Revision, Copyright December, 2002, which is hereby incorporated by reference herein. USB is a cable bus that supports data exchange between a host and a wide range of simultaneously accessible peripherals. The bus allows peripherals to be attached, configured, used, and detached while the host and other peripherals are in operation. This is referred to as hot plug.

Figure 2:
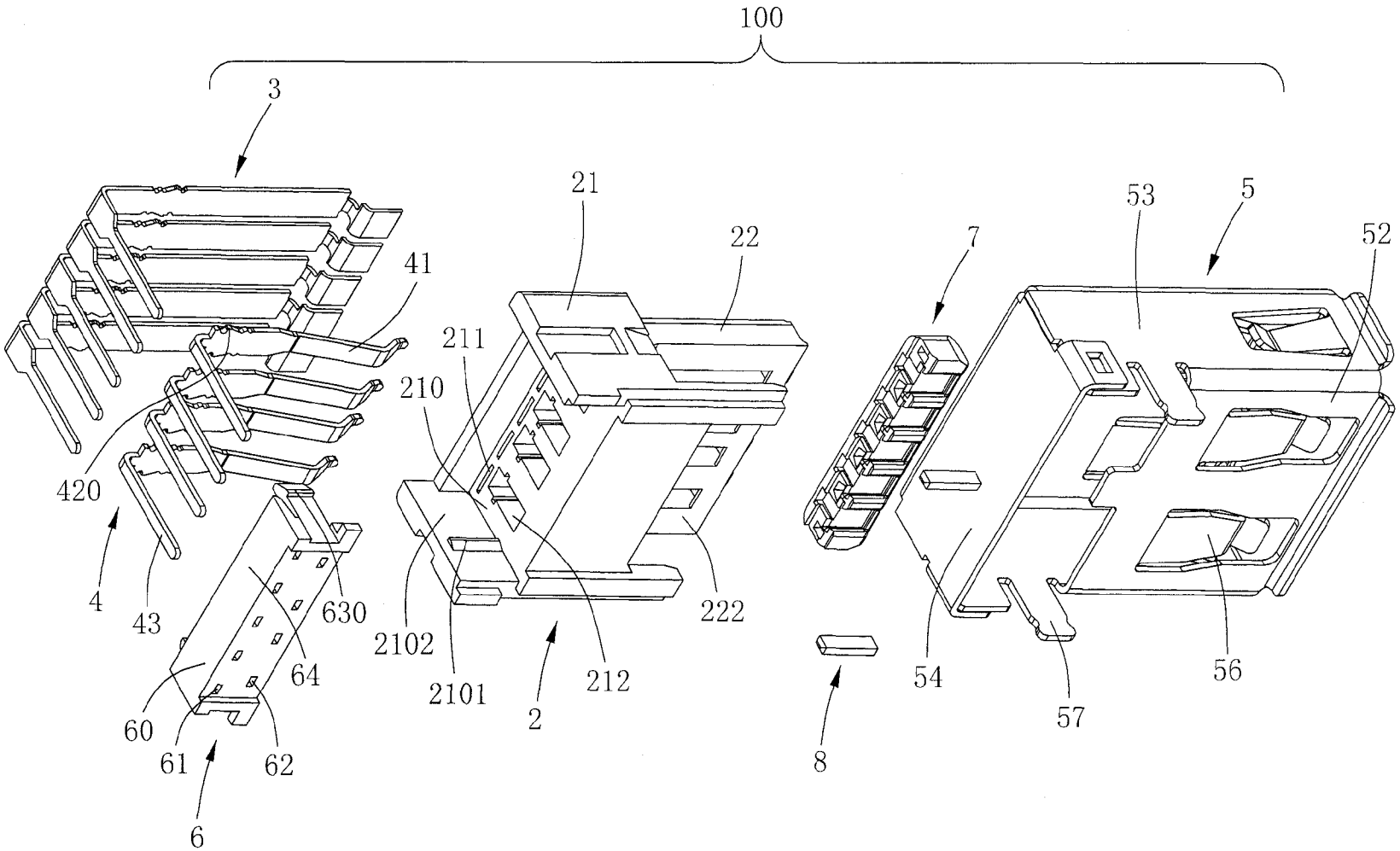
FIG. 2 is a view similar to FIG. 1, but viewed from a different aspect.

Referring to FIGS. 1-2, an electrical connector 100 according to a preferred embodiment of the present invention is disclosed. The electrical connector 100 comprises an insulative housing 2, five first conductive contacts 3 assembled in the insulative housing 2, and four second contacts 4 assembled in the insulative housing 2, a metal shell 5 enclosing the insulative housing 2 and the contacts 3, 4, and a retainer 7 assembled to the insulative housing 2. In the preferred embodiment of the present invention, the electrical connector 100 fulfills the transmission standard of USB 3.0 and is compatible with interface of the A-type USB 2.0. Detail description of these elements and their relationship and other elements formed thereon will be detailed below.

Referring to FIGS. 1-4, the insulative housing 2 comprises a rectangular base portion 21 and a tongue portion 22 extending forwardly from a middle of a front surface of the base portion 21. The base portion 21 and the tongue portion 22 of the insulative housing 2 are integrally injecting molded as a unit one piece. The base portion 21 defines a rectangular termination space 210 recessed forwardly from a rear surface thereof, a plurality of first contact-receiving passageways 211 arranged in an upper row, and a plurality of second contact-receiving passageways 212 arranged in a lower row. The termination space 210 is of U-shape and forms a pair of latch sections 2101 extending along front-to-back direction on a pair of lateral walls 2102 of the base portion 21. A U-shape supporting arm 214 extends forward from a lower section of a front face of the base portion 21 till below a middle portion of the tongue portion 22 for supporting the metal shell 5.

The tongue portion 22 has an upper first supporting surface 221 and opposite lower second supporting surface 222. Four second contact-receiving passages 224 are recessed upward from the second supporting surface 222 to communicate with respectively second contact-receiving passageways 212. Five first contact-receiving passages 223 communicate with corresponding first contact-receiving passageways 211 and penetrate through the tongue portion 22. The tongue portion 22 defines five slots 2210 recessed downward from the first supporting surface 221 to communicate with respective first contact-receiving passages 223. The width of each slot 2210 is narrower than that of the first contact-receiving passage 223, that means the first supporting surface 221 still partially covers the first contact-receiving passage 223. The first contact-receiving passages 223 and the second contact-receiving passages 224 respectively occupy the first supporting surface 221 and the second supporting surface 222 along a front-to-back direction, while the first contact-receiving passages 223 communicate with a front ending face 225 of the tongue portion 22.

Figure 3:
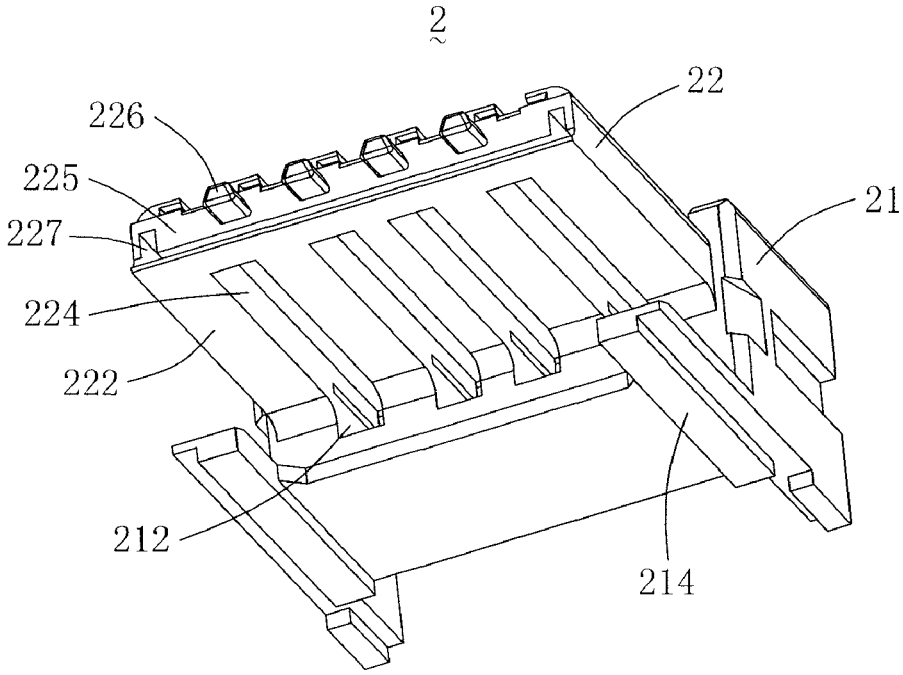
FIG. 3 is a perspective view of an insulative housing of the electrical connector.
Figure 4:
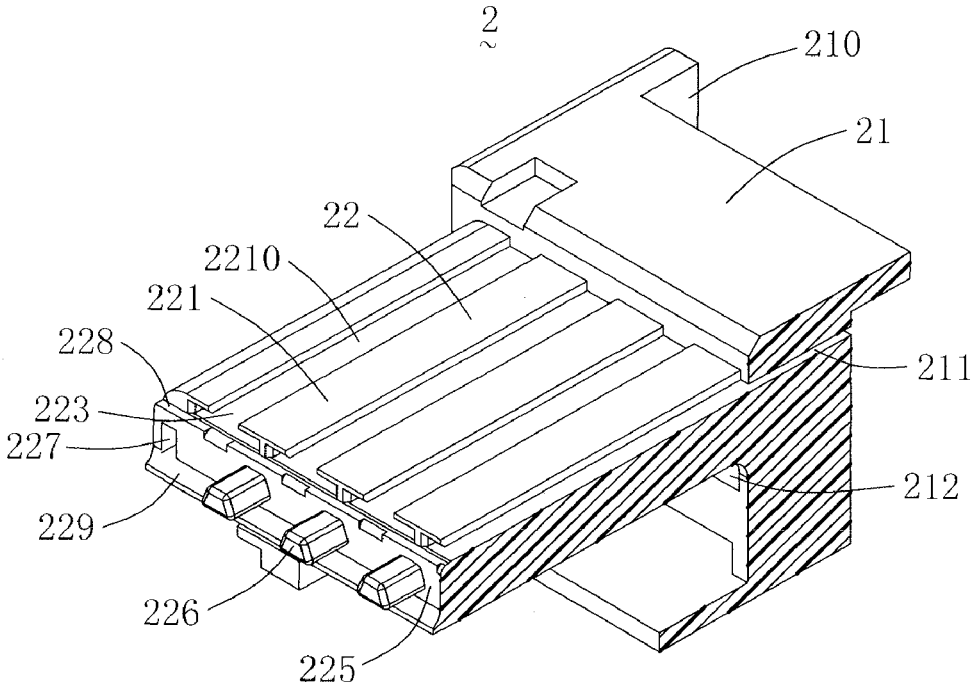
FIG. 4 is a partially cross-section view of the insulative housing.
Figure 5:
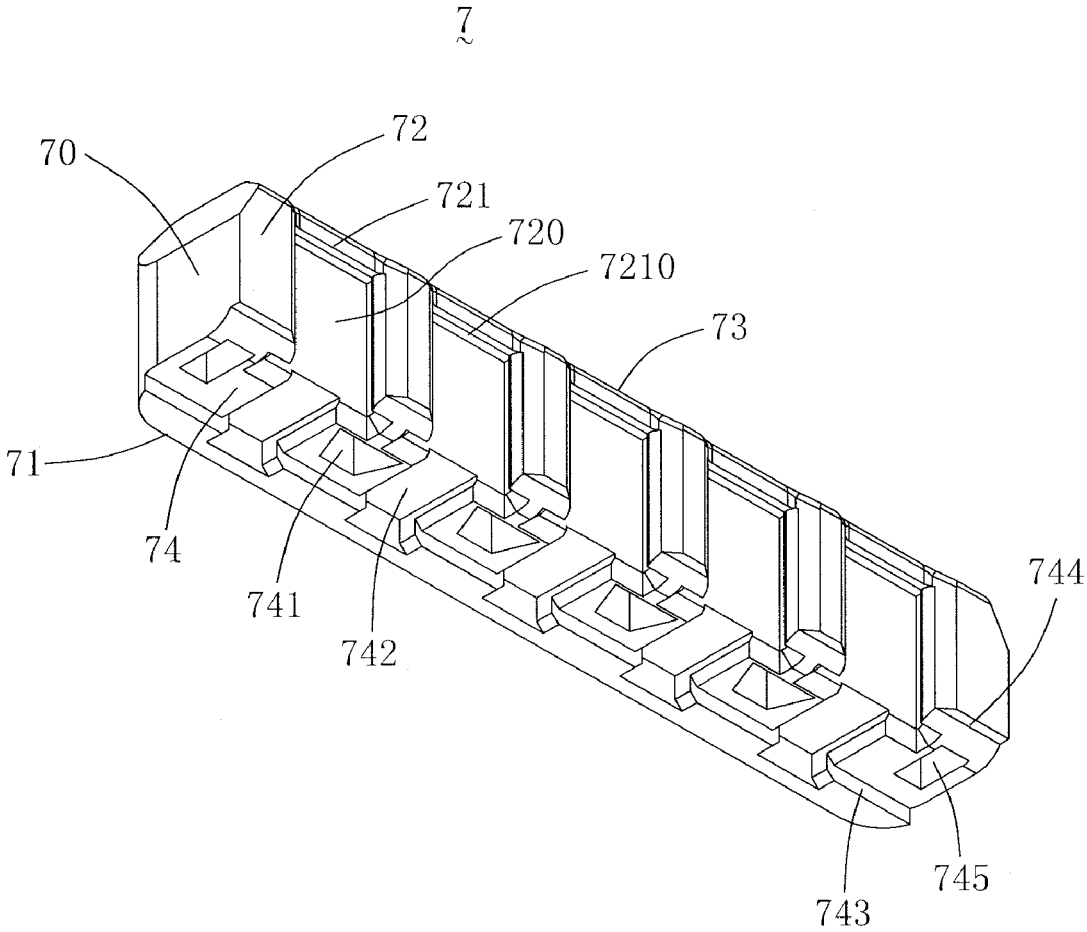
FIG. 5 is a perspective view of a retainer of the electrical connector of the present invention.
Figure 6:
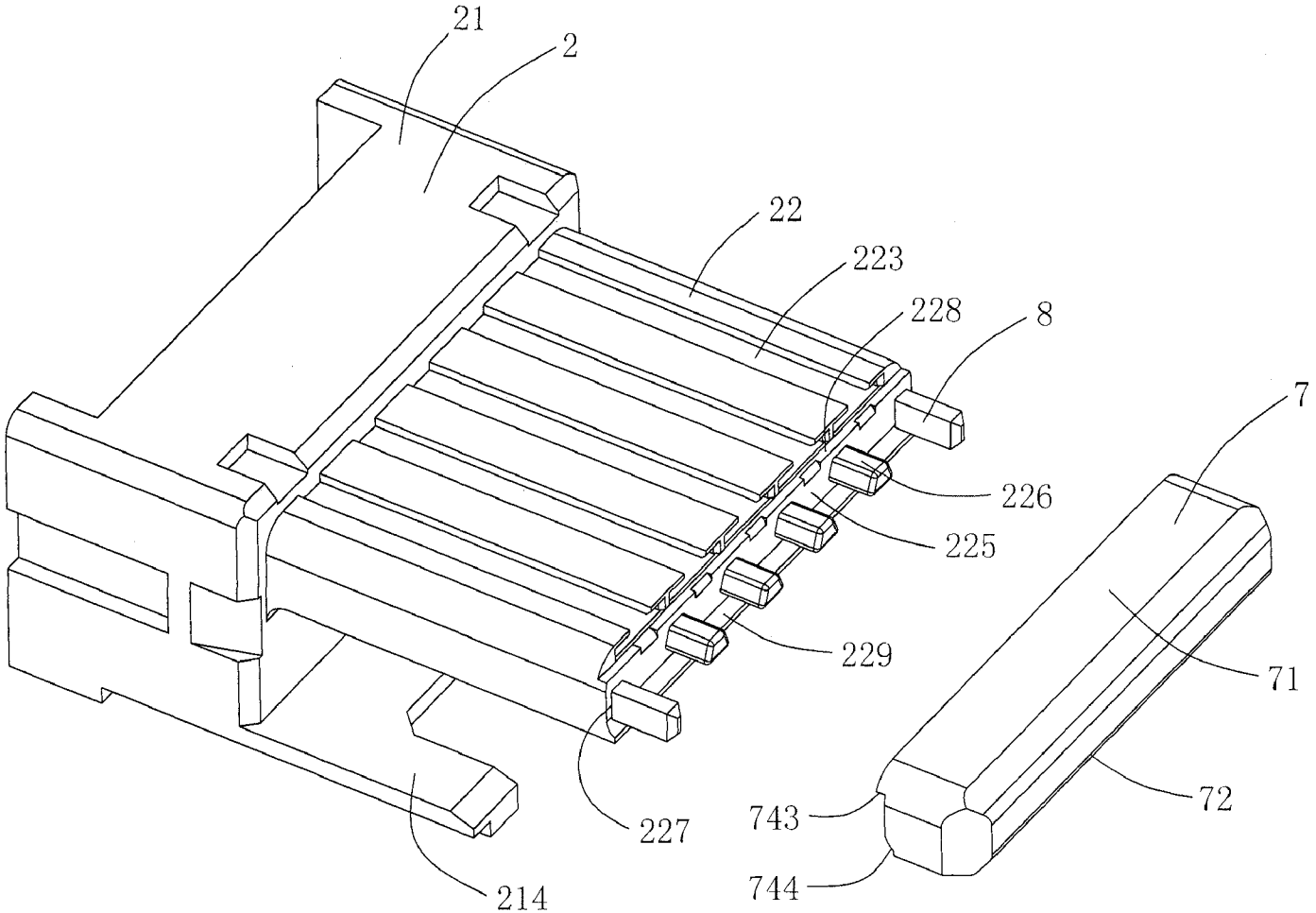
FIG. 6 is a partially assembled view illustrating the insulative housing, the retainer and a pair of guiding bars.
Figure 8:
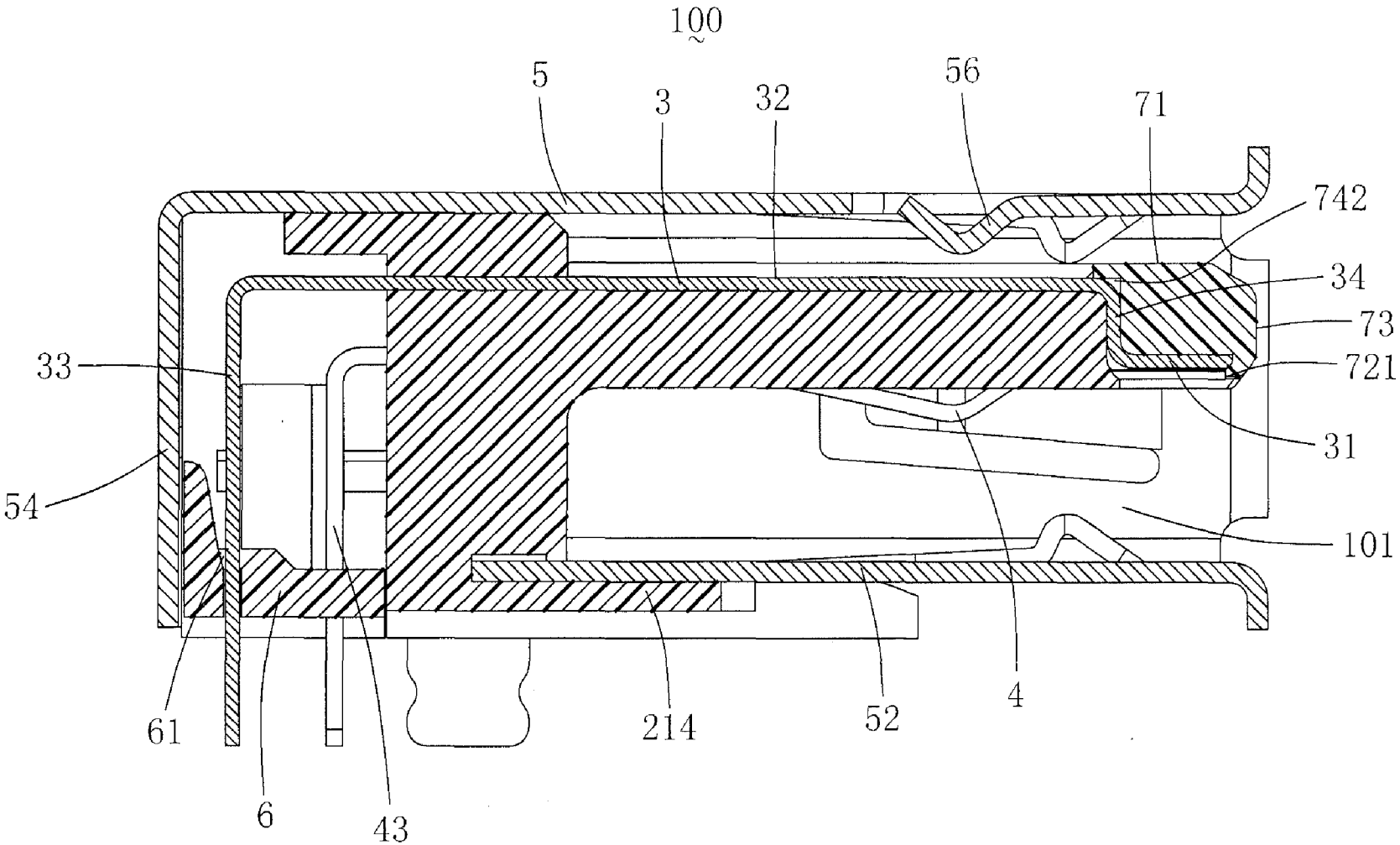
FIG. 8 is a cross-sectional view taken along line 8-8 of FIG. 7.
Figure 9:
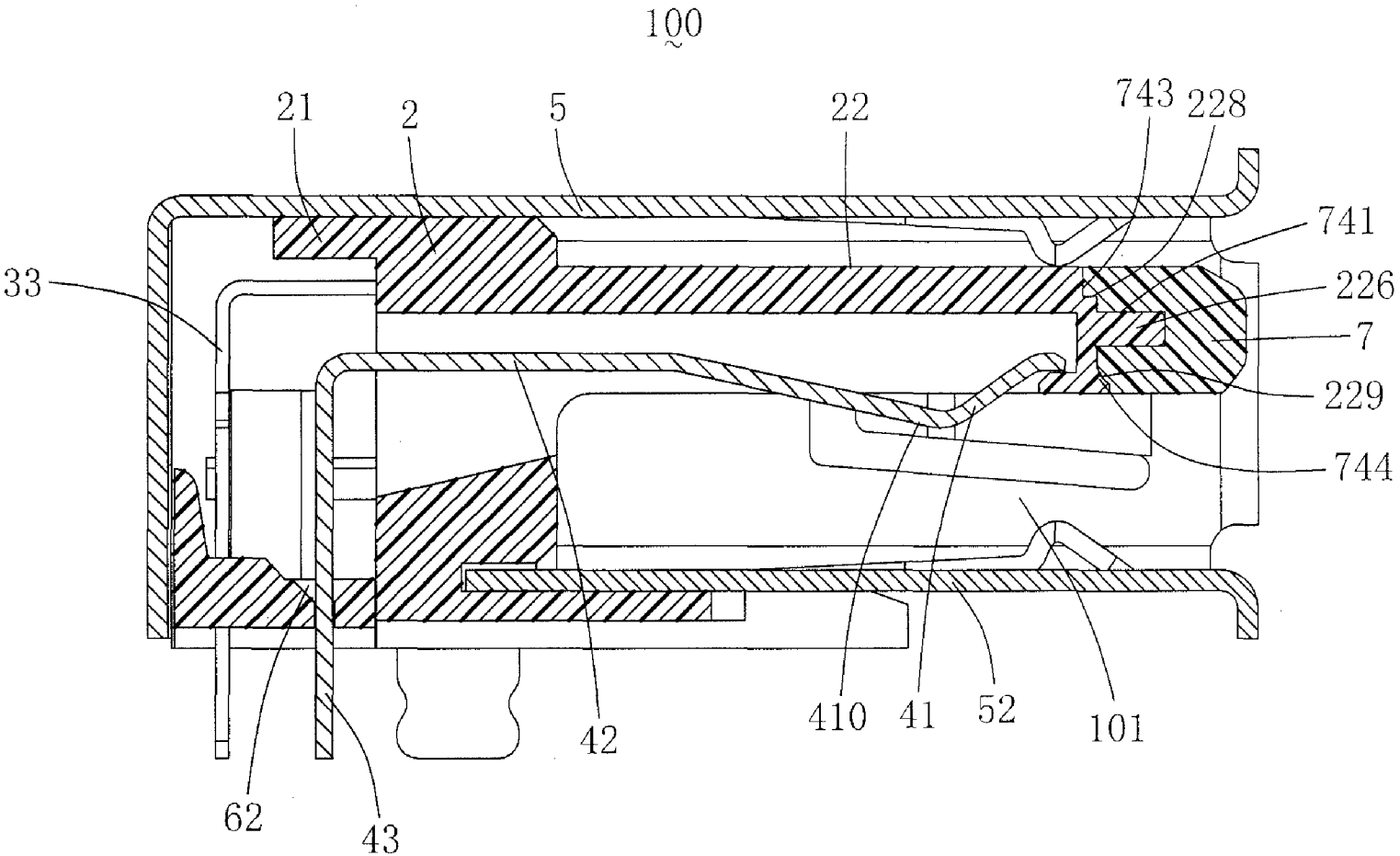
FIG. 9 is a cross-sectional view taken along line 9-9 of FIG. 7.
Figure 10:
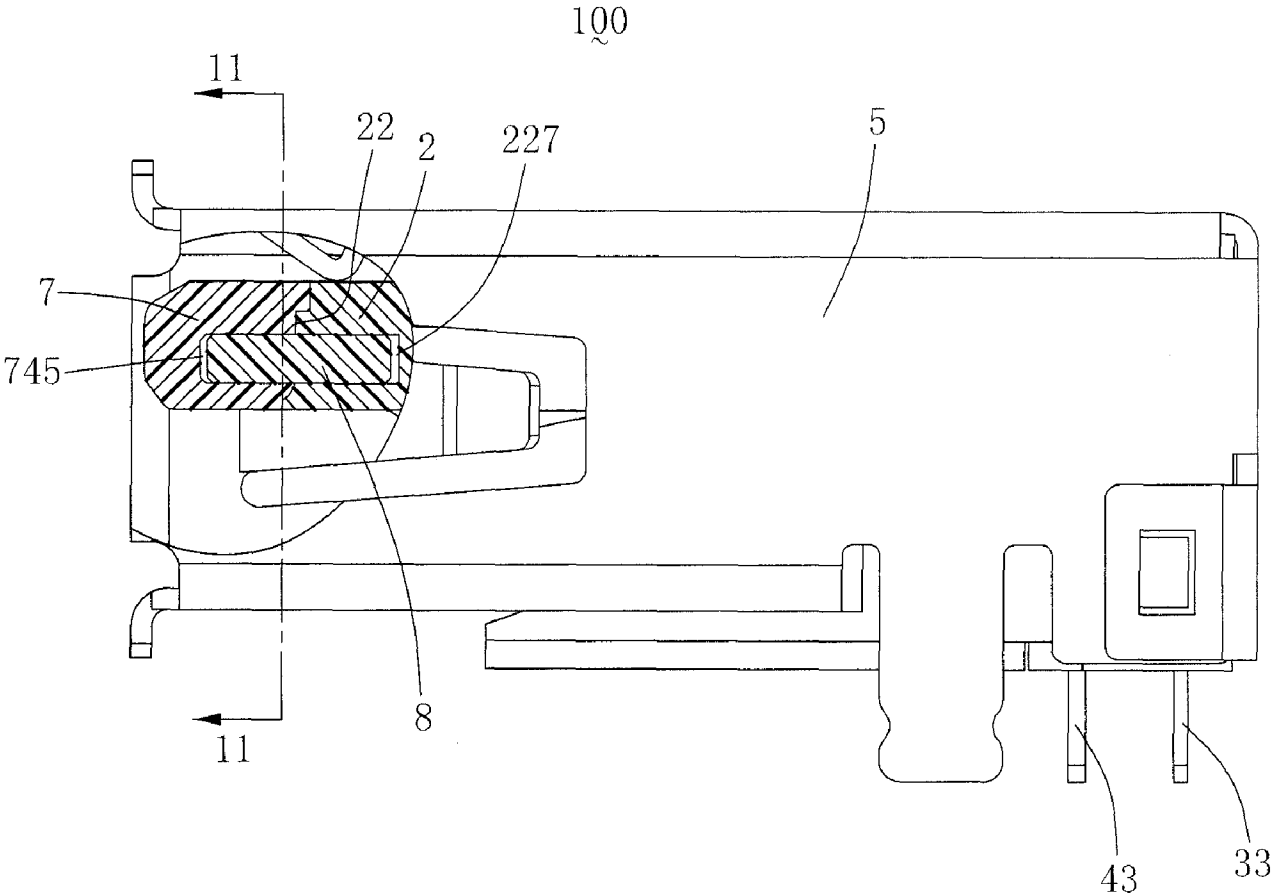
FIG. 10 a partially cross-sectional view of the electrical connector.
Figure 11:
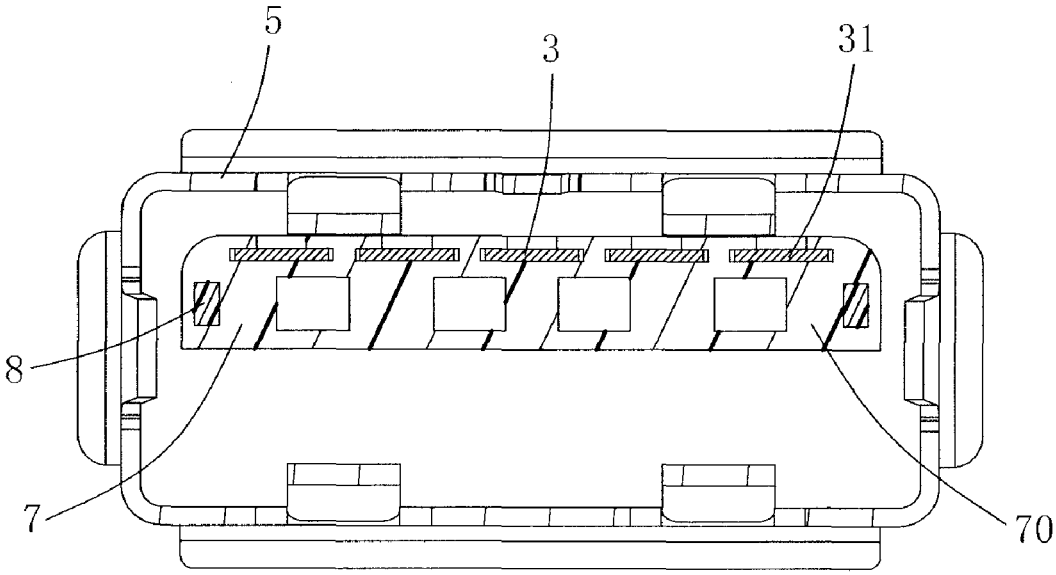
FIG. 11 is a cross-sectional view taken along line 11-11 of FIG. 10.

Please specially refer to FIGS. 3-4 in conjunction with FIGS. 8-9, four wedge-shape combination portions 226 extend forwardly from the front ending face 225 of the tongue portion 22. The combination portions 226 are alternatively arranged along the front ending face 225 with each combination portion 226 located between two adjacent first contact-receiving passages 223 viewed from the front-to-back direction. The upper section of the front ending face 225 is partially cutoff to form a first step portion 228 and an arc-shape second step portion 229 extends forwardly from a lower section of the front ending face 225. A pair of rectangular aligning slots 227 is recessed rearward from the front ending face 225 and is respectively located at opposite lateral sides of the tongue portion 22.

Referring to FIGS. 1-2 in conjunction with FIGS. 8 and 9, the first conductive contacts 3 are assembled to the insulative housing 2 from front-to-back direction. Each first contact 3 comprises a first retention portion 31 interferentially received in the first contact-receiving passageway 211 and the first contact-receiving passage 223, a flat first mating portion 31 exposed beyond the front ending face 225 of the tongue portion 22 for electrically connecting with a complementary connector (not shown), a connecting portion 34 connecting the first mating portion 31 and the first retention portion 32 and a first tail portion 33 bending downward from the first retention portion 32 to be exposed into the termination space 210. The connecting portion 34 is substantially of L-shape to connect the first mating portion 31 and the first retention portion 32 which locate in different surfaces. In the preferred embodiment of the present invention, the first retention portion 32 and the first mating portion 31 are parallel to each other and with the same width as each other. The width of the connecting portion 34 is narrower than that of the first mating portion 31 and the first retention portion 32. The connecting portion 34 attaches to the front ending face 25 of the tongue portion 22 after the first conductive contact 3 is assembled to the insulative housing 2. Opposite lateral sides of the first mating portion 31 and the first retention portion 32 can be disposed with a plurality of barbs (interference sections) for improving the retention force with the retainer 7 and insulative housing 2. In the preferred embodiment of the present invention, the first retention portion 32 arranges a plurality of barbs (interference sections) 320 on opposite lateral sides thereof. The five first conductive contacts 3 comprise two pairs of differential contacts for high-speed signal transmission, and a grounding contact located between the two pairs of differential contacts for suppressing cross-talk. One differential pair is used for receiving signals, and the other differential pair is used for transmitting signals. After the first conductive contact 3 is assembled to the insulative housing 2, the tail portion 33 is bent to be received in the termination space 210.

Please refer to FIGS. 1-2 and 9, the second conductive contacts 4 are assembled to the insulative housing 2 along back-to-front direction that is a direction opposite to that of the first conductive contacts 3. Each second contact 4 comprises a flat second retention portion 42 interferentially received in the second contact-receiving passageways 212, a second mating portion 41 extending forwardly from the second retention portion 42 and elastically curved upwardly, and a second tail portion 43 extending rearward from the second retention portion 42 then bending downwardly. The second retention portion 42 forms a plurality of barbs (interference sections) 420 on opposite lateral sides thereof for interferentially engaging with the second contact-receiving passageways 212. The second mating portion 41 is partially received in the second contact-receiving passage 224 with curved contacting section 410 located below the second supporting surface 222 for forming electrical connection with the complementary connector. The four second contacts 4 comply with USB 2.0 standard, and one is a power contact, two are a pair of positive and negative contacts, and one is a grounding contact in turn.

Please refer to FIGS. 1-2 in combination with FIGS. 7-11, the shell 5 is stamped from a metal sheet and comprises a rectangular receiving space 55 circumscribed by opposite upper and lower walls 51, 52, opposite left and right lateral walls 53 and a rear wall 54. The insulative housing 2 is received in the receiving space 55 of the shell 5 with the upper wall 51 forming a mating space 101 together with the second supporting surface 222 for receiving the complementary connector to form electrical connection with the first and second conductive contacts 3, 4. Except the rear wall 54, each wall of the shell 5 is formed with a plurality of elastic fingers 56 for elastically abutting against a metal shell of the complementary connector to form shielding protection. The shell 5 is assembled to the insulative housing 2 along the front-to-back direction to interferentially engage with the base portion 21. The lower wall 52 is received between the tongue portion 22 and the supporting arm 214. The rear wall 54 is bent downwardly to seal the termination space 210. Each lateral wall 53 is formed with a board-lock 57 extending downwardly therefrom for locking with a printed circuit board to which the electrical connector 100 is mounted. The first and second mating portions 31, 41 are exposed in the mating space 101 and the first retention portion 32 partially face to the upper wall 51.

Figure 7:
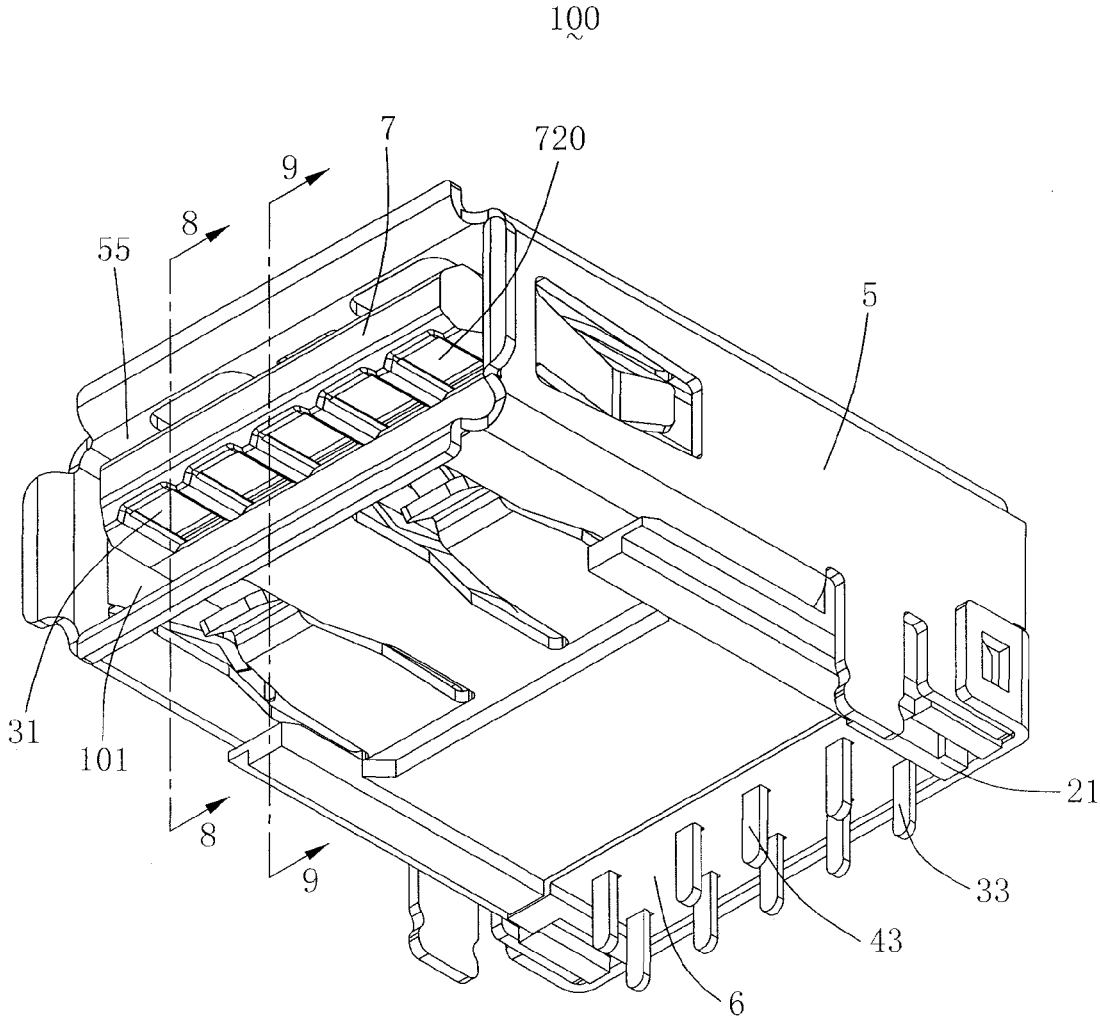
FIG. 7 is an assembled, perspective view of the electrical connector of the present invention.

Referring to FIGS. 1-2 in conjunction with FIGS. 7-9, the electrical connector 100 in accordance with the present invention also comprises a spacer 6 which is assembled to the insulative housing 2 along down-to-up direction to latch with the insulative housing 2 for aligning the tail portions 33, 43 of the first and second conductive contacts 3, 4. The spacer 6 comprises a main body 60 defining five first retaining holes 61 arranged in a rear row and four second retaining holes 62 arranged in a front row, a pair of latch sections 63 extending upwardly from opposite lateral sides of the main body 60, and a block portion 64 extending upwardly from a rear edge of the main body 60. When the spacer 6 is assembled to be received in the termination space 210 of the insulative housing 2, latches 630 formed at free ends of the latch sections 63 latch with the latch sections 2101 to secure the spacer 6. The tail portions 33, 43 of the contacts 3, 4 respectively protrude through the first and second retaining holes 61, 62 then electrically connect to the printed circuit board.

Please refer to FIGS. 1-2 in conjunction with FIGS. 5-11, the retainer 7 is of rectangular block shape and comprises a rectangular main portion 70. The main portion 70 comprises opposite front face 73 and rear face 74, and opposite first face 71 and second face 72 perpendicular to the front and rear faces 73, 74. Five receiving slots 720 are recessed upwardly from the second face 72 a certain distance. The receiving slots 720 are located in a different surface from that of the first contact-receiving passages 223 to receive the first mating portions 31 of the first conductive contacts 3. Each receiving slot 720 does not communicate with the front face 73, and the portion of the front edge (not labeled) of the retainer 7 located below the receiving slots 720 forms five arc-shape protection portions 721. A protecting slit 7210 is formed between the protection portion 720 and a bottom surface of the receiving slot 720. A front edge 310 of each first conductive contact 3 is received in the protecting slit 7210 and is protected by the protection portion 721. Thus, the front edge 310 of the first conductive contact 3 is prevented from facing to the complementary connector directly, and also prevented from touching with a metal shell of the complementary connector. That is, ESD (ElectricStatic Discharge) phenomenon is prevented from being occurred and better protection is provided to the electric components.

Four wedge-shape combination holes 741 are recessed from the rear face 74 toward the front face 73 of the retainer 7 to tightly engage with the combination portions 226 of the tongue portion 22 for assembling the retainer 7 to the insulative housing 2. Five L-shape receiving channels 742 are recessed forwardly a certain distance from the rear face 74 and alternatively arranged on the rear face 74 with the combination holes 741. The width of the receiving channel 742 is narrower than that of the receiving slot 720 and the connecting portion 34 is sandwiched between the receiving channel 742 of the retainer 7 and the front ending face 225 of the tongue portion 22. A pair of aligning slots 745 aligning with the aligning slots 227 are recessed from the rear face 74 toward the front face 73. A pair of guiding bars 8 are firstly assembled into the aligning slots 227 with forward ends longer than the combination portions 226 for guiding the retainer 7 to be assembled to the insulative housing 2 properly, also for increasing combination reliability between the retainer 7 and the insulative housing 2. Corresponding to the first and second step portions 228, 229, please refer to FIGS. 8 and 9, a first protruding section 743 protrudes rearward from the upper edge of the rear face 74 to cooperate with the first step portion 228. A second protruding section 744 protrudes rearward from the lower edge of the rear face to cooperate with the second step portion 229. Hence, via the structures described above, the retainer 7 is tightly assembled to the insulative housing 2 with the first mating portion 31 and the connecting portion 34 received between the retainer 7 and the insulative housing 2.

It is no need to utilize high-technology to manufacture the first and second sets of contacts 3, 4 and the insulative housing 2 of the present invention. Current molds can satisfy the manufacture needs. The non-elastic Z-shape first mating portions 31 of the first contacts 3 are of simple configuration and enough intensity. The assembled first and second conductive contacts 3, 4 are of lower cost to increase competition ability of the product. In addition, the mating portions 31, 41 of the contacts 3, 4 all are located at the same side of the insulative housing 2, which is the second supporting surface 222. But, in an alternative embodiment, the mating portions 31, 41 can be arranged to be located at different sides of the insulative housing 2, which is the first and second supporting surfaces 221, 222. In addition, the first conductive contacts 3 are retained between the retainer 7 and the insulative housing 2 to prevent ESD phenomenon between the front edges 310 and the complementary connector. Thus, the electrical connector 100 gains enough protection.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector defining a mating direction, comprising:

an insulative housing comprising a rear base portion and a front tongue portion extending from the base portion along the mating direction;

a plurality of first conductive contacts held in the insulative housing and comprising at least one pair of differential contacts for transmitting high-speed signals, each first conductive contact comprising a nonelastic first mating portion exposed beyond the tongue portion, a first retention portion received in the base portion and the tongue portion of the insulative housing and located in a surface different from that of the first mating portion, a first tail portion extending from the first retention portion and extending beyond the base portion;

a plurality of second conductive contacts held in the insulative housing, and each second conductive contact comprising an elastic second mating portion received in the tongue portion to be located behind the nonelastic first mating portion along the mating direction, a second retention portion interferentially received in the base portion of the insulative housing, and a second tail portion extending from the second retention portion and beyond the base portion;

a retainer assembled to the tongue portion of the insulative housing, the retainer comprising opposite first and second faces and defining a plurality of receiving slots recessed from at least one of the first and second faces to receive the nonelastic first mating portions of the first conductive contacts.

2. The electrical connector as claimed in claim 1, wherein the retainer comprises a front edge partially protruding below/above the receiving slots to form a plurality of protecting slits, wherein front edges of the first conductive contacts are respectively received in the protecting slits.

3. The electrical connector as claimed in claim 2, wherein the first mating portion and the first retention portion are located in different surfaces parallel to each other, and wherein the first conductive contact comprises a connecting portion connecting the first mating portion and the first retention portion.

4. The electrical connector as claimed in claim 3, wherein the retainer defines said receiving slots recessed from the second face toward the first face, and wherein the front edge of the retainer forms a plurality of protection portions by partially extending below the receiving slots, and wherein said protecting slits are formed between the protection portions and the receiving slots.

5. The electrical connector as claimed in claim 3, wherein the retainer comprises opposite front face and rear face, and wherein the tongue portion comprises a front ending face facing to the rear face of the retainer, a plurality of receiving channels are recessed along the mating direction from at least one of the rear face of the retainer and the front ending face of the tongue portion to receive the connecting portions of the first conductive contacts.

6. The electrical connector as claimed in claim 5, wherein the receiving channels are recessed from the rear face of the retainer, and wherein the connecting portion of each first conductive contact abuts against the front ending face of the tongue portion and is received in the receiving channel.

7. The electrical connector as claimed in claim 5, wherein at least one of the front ending face of the tongue portion and the rear face of the retainer forms a plurality combination portions, and wherein at least one of the rear face of the retainer and the front ending face of the tongue portion defines a plurality combination holes to interferentially receive said combination portions.

8. The electrical connector as claimed in claim 7, wherein the combination portions and the combination holes are of wedge shape to increase the retention force between the retainer and the insulative housing.

9. The electrical connector as claimed in claim 5, wherein each of the tongue portion and the retainer defines a pair of aligning slots along the mating direction, and wherein a pair of guiding bars are respectively received in the aligning slots of the retainer and the tongue portion.

10. The electrical connector as claimed in claim 1, wherein the first conductive contacts and the second conductive contacts are assembled to the insulative housing along opposite directions, and wherein the retainer is assembled to the tongue portion after the first conductive contacts are assembled to the insulative housing.

11. The electrical connector as claimed in claim 1, wherein the first conductive contacts further comprise another pair of differential contacts, and a grounding contact located between the two pairs of differential contacts.

12. The electrical connector as claimed in claim 1, wherein the geometric profile of the tongue portion is substantially same as that of a standard type-A USB 2.0 plug.

13. The electrical connector as claimed in claim 1, wherein the second set of contacts is adapted for USB protocol and an arrangement of the second set of contacts is compatible to a standard USB receptacle, and wherein the pair of differential contacts are adapted for non-USB protocol.

14. The electrical connector as claimed in claim 1, further comprising a shell enclosing the insulative housing, and wherein a mating space is defined by the shell and the tongue portion of the insulative housing, and the first and second mating portions of the first and second conductive contacts are exposed into the mating space.

15. The electrical connector as claimed in claim 1, further comprising a spacer assembled to the base portion of the insulative housing, and wherein the first and second tail portions of the first and second conductive contacts are aligned by the spacer.

16. The electrical connector as claimed in claim 1, wherein the tongue portion defines opposite first supporting surface and second supporting surface both parallel to the mating direction, and a plurality of front first contact-receiving passages to communicate with at least one of the first and second supporting surfaces, and a plurality of rear second contact-receiving passages to communicate with at least one of the first and second supporting surfaces, and wherein the first retention portion is partially received in the first contact-receiving passages, and the second mating portion of the second conductive contact is partially received in the second contact-receiving passage.

17. The electrical connector as claimed in claim 16, wherein the base portion of the insulative housing defines a plurality of first contact-receiving passageways and a plurality of second contact-receiving passageways, and wherein the first retention portions of the first conductive contacts are partially received in the first contact-receiving passageways, and the second retention portions of the second conductive contacts are received in the second contact-receiving passageways.

18. An electrical connector defining a mating direction, comprising:

an insulative housing comprising a rear base portion and a front tongue portion extending from the base portion along the mating direction;

a plurality of first conductive contacts held in the insulative housing and comprising at least one pair of differential contacts for transmitting high-speed signals, each first conductive contact comprising a nonelastic first mating portion exposed beyond the tongue portion, a first retention portion received in the base portion and the tongue portion of the insulative housing and located in a surface different from that of the first mating portion, a first tail portion extending from the first retention portion and extending beyond the base portion, and a connecting portion connecting the first mating portion and the first retention portion;

a plurality of second conductive contacts held in the insulative housing, and each second conductive contact comprising an elastic second mating portion received in the tongue portion to be located behind the nonelastic first mating portion along the mating direction, a second retention portion interferentially received in the base portion of the insulative housing, and a second tail portion extending from the second retention portion and beyond the base portion;

a retainer assembled to the tongue portion of the insulative housing, the retainer comprising opposite first and second faces and defining a plurality of receiving slots recessed from at least one of the first and second faces to receive the nonelastic first mating portions of the first conductive contacts, and the connecting portions of the first conductive contacts are sandwiched between the tongue portion of the insulative housing and the retainer.

19. The electrical connector as claimed in claim 18, wherein the retainer defines a plurality of receiving channels recessed from a rear face thereof, and wherein the connecting portion is received in the receiving channel and abuts against the tongue portion of the insulative housing.

20. The electrical connector as claimed in claim 18, wherein the retainer comprises a front edge partially protruding below/above the receiving slots to form a plurality of protecting slits, wherein front edges of the first conductive contacts are respectively received in the protecting slits.

* * * * *